US005732561A

United States Patent [19]

Kim

[11] Patent Number: 5,732,561

[45] Date of Patent: Mar. 31, 1998

[54] METHODS AND APPARATUS FOR COOLING TWO REFRIGERATOR COMPARTMENTS UTILIZING ONE EVAPORATOR

[75] Inventor: Kwang Il Kim, Suwon, Rep. of Korea

[73] Assignee: Samsung Electronics Co., Ltd., Suwon, Rep. of Korea

[21] Appl. No.: 753,331

[22] Filed: Nov. 22, 1996

[30] Foreign Application Priority Data

Nov. 23, 1995 [KR] Rep. of Korea ..... 1995-43171

[51] Int. Cl.[6] ..... F25D 17/08

[52] U.S. Cl. ..... 62/89; 62/187

[58] Field of Search ..... 62/187, 443, 89, 62/291

[56] References Cited

U.S. PATENT DOCUMENTS 4,122,687 10/1978 McKee ..... 62/187

4,614,092 9/1986 Kim et al. ..... 62/187

5,406,805 4/1995 Radermacher et al. ..... 62/81

5,487,277 1/1996 Bessler ..... 62/187

*Primary Examiner*—William E. Tapolcai

*Attorney, Agent, or Firm*—Burns, Doane, Swecker & Mathis, L.L.P.

[57] ABSTRACT

A refrigerator includes refrigerating and freezing compartments and a cooling cycle mechanism having only one evaporator. When either of the compartments needs to be cooled, the cooling cycle mechanism is started-up and operated to cool the refrigerating compartment, but not the freezing compartment, until refrigerant pressure in the evaporator reaches a steady state condition. Then, if the freezing compartment needs cooling, it is cooled. Thereafter, if the refrigerating compartment needs cooling, it is cooled. During periods when neither of the compartments needs cooling, the cooling cycle mechanism is shut down, and air from the refrigerating compartment is conducted through the evaporator to defrost the evaporator.

11 Claims, 8 Drawing Sheets

METHODS AND APPARATUS FOR COOLING TWO REFRIGERATOR COMPARTMENTS UTILIZING ONE EVAPORATOR

BACKGROUND OF THE INVENTION (1) Field of the Invention

The present invention generally relates to a refrigerator which maintains refrigerating and freezing compartments at different temperatures. The present invention further relates to a cooling operation control method for such a refrigerator.

(2) Description of the Prior Art

FIG. 1 depicts a refrigerator according to a conventional art. The refrigerator of FIG. 1 includes a body 1, a freezing compartment 2 and refrigerating compartment 2*a* which are separated by a partition, an evaporator 3 which is installed in the partition and generates cooled air, a fan 4 which is provided behind the evaporator 3 and forcedly circulates the air of the respective freezing and refrigerating compartments 2 and 2*a* the air having been passed through the evaporator 3 from the freezing and refrigerating compartments 2 and 2*a*.

The refrigerator also includes a refrigerating compartment damper 8 that is installed within the rear wall of the refrigerating compartment 2*a* and controls the flow of the cool air that is forcedly circulated in the refrigerating compartment 2*a* by the fan 4, a refrigerating compartment thermistor 7 which detects temperatures of the refrigerating compartment 2*a*, a freezing compartment thermistor 6 which detects temperatures of the freezing compartment 2, and a compressor 5 which is installed on the lower section of the body 1 and plays an important roll in a cooling cycle together with the evaporator 3.

The operation of the conventional refrigerator having such a construction will now be described with reference to a flow chart of FIG. 2.

Once power is applied to the refrigerator, the freezing compartment thermistor 6 and refrigerating compartment thermistor 7 detect the temperatures of the freezing and refrigerating compartments each. The temperature of the freezing compartment 2 detected by the freezing compartment thermistor 6 is compared with a preset temperature A at Step 1 so as to determine the operating conditions of the compressor 5 and the fan 4. When the temperature of the freezing compartment 2 is higher than the preset temperature A, the compressor 5 and fan 4 are actuated at Step 2 to circulate the air of the freezing compartment 2 into the evaporator 3 so that the air of the freezing compartment 2 is cooled through heat exchange with the evaporator 3 and is then forced into the freezing compartment 2 for the purpose of cooling the freezing compartment 2.

On the contrary, if the temperature of the freezing compartment 2 is lower than the preset temperature A, the compressor 5 and fan 4 stop their operations to enter Step 4. After operating the compressor 5 and fan 4 at Step 2, the refrigerating compartment thermistor 7 detects the refrigerating compartment's temperature, and the resultant temperature of the refrigerating compartment 2*a* is compared with a preset temperature B.

If the temperature of the refrigerating compartment 2*a* is higher than the preset temperature B, the refrigerating compartment damper 8 is opened at Step 5 to blow the air of the refrigerating compartment 2*a* across the evaporator 3 so that the air of the refrigerating compartment 2*a* is cooled through heat exchange with the evaporator 3 and is then forced into the refrigerating compartment 2*a* to thereby cool the refrigerating compartment 2*a*, while also cooling the freezing compartment. When the temperature of the refrigerating compartment 2*a* is lower than the preset temperature B, the refrigerating compartment damper 8 is closed at Step 6 in order to prevent the refrigerating compartment 2*a* from being overcooled.

In the conventional refrigerator, the air cooled by way of the evaporator is distributed to the freezing compartment 2 and the refrigerating compartment 2*a* in the ratio of about 7:3. Thus, when the temperature of the refrigerating compartment 2*a* is higher than its standard temperature and the temperature of the freezing compartment 2 is lower than its standard temperature, it takes much time to cool the refrigerating compartment 2*a* below its standard temperature, which increases energy consumption and makes the freezing compartment 2 be relatively overcooled.

There is disclosed U.S. Pat. No. 5,406,805, (Date of Patent: Apr. 18, 1995) entitled "Tandem Refrigeration System" employing at least one evaporator in order to reduce energy consumption, for cooling the freezing and fresh food compartments at different temperatures, which is schematically depicted in FIG. 3. As shown in FIG. 3, the '805 Patent's refrigerator includes a first evaporator 2' (freezer evaporator) which is provided for cooling a freezing compartment 4' and a second evaporator 6' (fresh food evaporator) which is connected in series with the first evaporator 2' for cooling a fresh food compartment 8'. The freezer evaporator 2' is disposed under the fresh food evaporator 6'. A suitable line 10 interconnects the two evaporators such that after a refrigerant passes through the freezer evaporator 2', the entirety of the refrigerant flows into the fresh food evaporator 6'. Fans 12' and 14' are also provided for blowing air across the evaporators 2' and 6'.

After passing through the fresh food evaporator 6', the refrigerant flows through a heat exchanger 16' and then passes through a compressor 18' and a condenser 20'. After passing through the condenser 20', the refrigerant again passes through the heat exchanger 16', and then passes through a capillary tube 22'.

As represented at 24', an optional bypass line may also be provided to connect an inlet 26' of the freezer evaporator 2' with an outlet 28' of the fresh food evaporator 6. A solenoid valve 30' is disposed in the line 24' such that the line 24' is closed during normal operation, but is selectively opened during a defrost operation. In this manner, the air cooled beyond the freezing point of the fresh food compartment flows through the freezer evaporator 2'.

According to the refrigerator of the '805 Patent, when the flow of the refrigerant stops in each evaporator 2' and 6', i.e. when the compressor 18' and fans 12' and 14' stop operating, the refrigerant in the evaporators 2' and 6' will have a higher pressure than the pressure established during operation of the compressor 18', which is maintained for a predetermined period of time after the compressor 18' begins operation. As a prescribed period of time elapses, the pressures of the refrigerant in the evaporators 2' and 6' come to be lowered.

For refrigerant R12, before the compressor 18' stops operating, the refrigerant will have a pressure of approximately 30 psi. The refrigerant R12 at this pressure is unsuitable for cooling of the freezing compartment 4' since the refrigerant temperature associated at this pressure could actually cause warming of the freezing compartment 4', or at least inefficient cooling. However, according to the conventional art, it has been recognized that even during initial operation of the system, the refrigerant R12 is suitable for cooling the fresh food compartment 8'. Accordingly, right after the operation of the compressor 18', the fan 14' is actuated to provide cooling for the fresh food compartment 8'. At this point, by the operation of the compressor 18', the pressure in each evaporator 2' and 6' is reduced to approximately 10–20 psi, and the fan 12' is actuated after the cooling operation of the fresh food compartment 8' has been completed, so the refrigerant in the freezer evaporator 2' evaporates to cool the freezing compartment 4'.

As should be readily apparent from the foregoing, the '805 Patent provides a refrigeration system with two evaporators for the freezing and food fresh compartments 4' and 8' to cool the food fresh compartments 8' during the initial operation of the compressor 18', resulting in an energy saving of approximately 10–20% over a standard single-stage system. Thus, the amount of frost created in the freezer evaporator 2' is reduced to thereby decrease power consumption due to the operation of a defrosting heater.

In case that the fan 12' or 14' stops during the operation of the compressor 18', the natural convection created by the evaporators may allow the freezing compartment or fresh food compartment to be overcooled, and, preferably, the inlet of each of the evaporators is designed to be higher than the top of each evaporator, and it is necessary to completely insulate the evaporators and prevent a leak of cool air.

The tandem refrigeration system disclosed in the '805 Patent can be applied to an electronic system only. If this tandem system is employed for a mechanical system, it is difficult to control the tandem system and to utilize the advantage of the tandem cycle in which two evaporators are connected in series with each other. Besides, after the operation of the compressor, when a steady-state pressure is achieved, the air of the freezing compartment comes in contact with the evaporator to thereby drop the evaporator's temperature quickly in such a manner that the freezing compartment is cooled at high speed. When the ambient temperature is high or the loads of the refrigerator are large, it is easy to secure the temperature of the freezing compartment but the cooling efficiency of the fresh food compartment is deteriorated.

If at least one evaporator is used in a refrigeration system, the components of the cooling cycle can be complicated in arrangement. Moreover, since two evaporators and two fans are provided for the respective freezing and fresh food compartments of a refrigerator, the refrigerator is of decreased capacity, resulting in an increase in the overall production costs.

SUMMARY OF THE INVENTION

It is the objective of the present invention to provide a refrigerator which can provide cooling of two or more compartments by using one evaporator.

It is another objective of the present invention to provide a refrigerator in which dampers are provided for respective freezing and refrigerating compartments and cool air is independently circulated into each compartment without using any secondary evaporator and fan, which lowers the overall production costs to thereby offer a refrigerator economical both in terms of manufacturing costs and cost of operation.

It is still another objective of the present invention to provide a refrigerator and a cooling operation control method for the refrigerator whereby its refrigerating compartment is cooled when an evaporator is in an transient pressure state during the operation of a compressor, and cooling is provided for a refrigerating or freezing compartment requiring cooling when the evaporator is free from the transient pressure state.

It is still further objective of the present invention to provide a refrigerator and a cooling operation control method for the refrigeration system whereby a fan and a damper are controlled to recirculate air of a refrigerating compartment by way of an evaporator during the down-time of a compressor without using a bypass line, a defrosting heater or a solenoid valve to thereby get rid of frost accumulating on the evaporator's surface.

To accomplish these and other advantages, the inventive refrigerator having at least freezing and refrigerating compartments and an evaporator, and providing a cooling cycle therewith, includes a first portion for independently cooling and maintaining the respective freezing and refrigerating compartments separated by a partition at different temperatures of steady state; and a second portion for cooling the refrigerating compartment by controlling the cooling cycle when the evaporator is in an transient pressure state.

The evaporator is in the transient pressure state for a predetermined period of time from the initial stage of the cooling cycle.

According to a further aspect of the present invention, a refrigerator having a freezing compartment and a refrigerating compartment separated by a partition, an evaporator provided to the inside of the partition, a compressor, and a fan, includes a pair of temperature sensors for detecting temperatures of the respective freezing and refrigerating compartments; at least one damper for blowing the air of each of the freezing and refrigerating compartments across the evaporator, and for independently circulating the air in each compartment in order to cool the freezing compartment and the refrigerating compartment independently of each other; and a control unit for cooling the refrigerating compartment during the transient pressure state of the evaporator by operating the compressor if any one of the temperatures of the respective freezing and refrigerating compartments is higher than a standard temperature preset for each compartment, and for preferentially providing cooling to the corresponding compartment whose temperature is higher than its standard temperature when the evaporator is free from the transient pressure state.

The control unit controls the operation of the fan and damper when the temperatures of the respective freezing and refrigerating compartments are all lower than their standard temperatures, and the control unit blows the air of the refrigerating compartment across the evaporator so as to perform a defrost operation while the compressor stops operating.

If the temperatures of the respective freezing and refrigerating compartments are all higher than their standard temperatures, the control unit controls the operation of the damper in order to cool first the freezing compartment after the evaporator is free from the transient pressure state.

The inventive refrigerator also includes a water collector that is installed under the evaporator and collects water created during the defrost operation; and an internal tube that has a vertical U-bend that prevents an inflow of ambient air and a leakage of cool air therethrough.

According to yet a further aspect of the present invention, a cooling operation control method for a refrigerator having at least freezing and refrigerating compartments and an evaporator, and providing a cooling cycle therewith, includes the steps of (a) determining whether or not anyone of the freezing and refrigerating compartments requires a cooling operation; (b) if anyone of the freezing and refrigerating compartments requires the cooling operation, starting the operation of the cooling cycle; (c) determining whether the evaporator reaches transient pressure state; (d) if the evaporator is in the transient pressure state, controlling the cooling cycle and cooling the refrigerating compartment; and (e) if the evaporator is free from the transient pressure state, controlling the cooling cycle and preferentially cooling the corresponding compartment requiring the cooling operation.

In case that both the freezing and refrigerating compartments require the cooling operation at the step (a), the freezing compartment is first cooled at the step (e).

The above method further includes the step of (f) if neither of the freezing and refrigerating compartments requires the cooling operation, i.e. if the temperatures of the respective freezing and refrigerating compartments are each lower than their standard temperatures, blowing the air of the refrigerating compartment beyond freezing across the evaporator by operating a fan and opening a refrigerating compartment damper, and defrosting ice accumulating on the evaporator.

The method yet further includes the step of (g) determining if the freezing compartment and the freezing compartment require the cooling operation, while blowing the air of the refrigerating compartment across the evaporator, and if anyone of the freezing and refrigerating compartments requires the cooling operation, repeating the procedures after the step (b).

DETAILED DESCRIPTION OF THE PREFERRED EMBODIMENT

The preferred embodiment of the present invention will be now described in detail with reference to the accompanying drawings.

Figure 1:
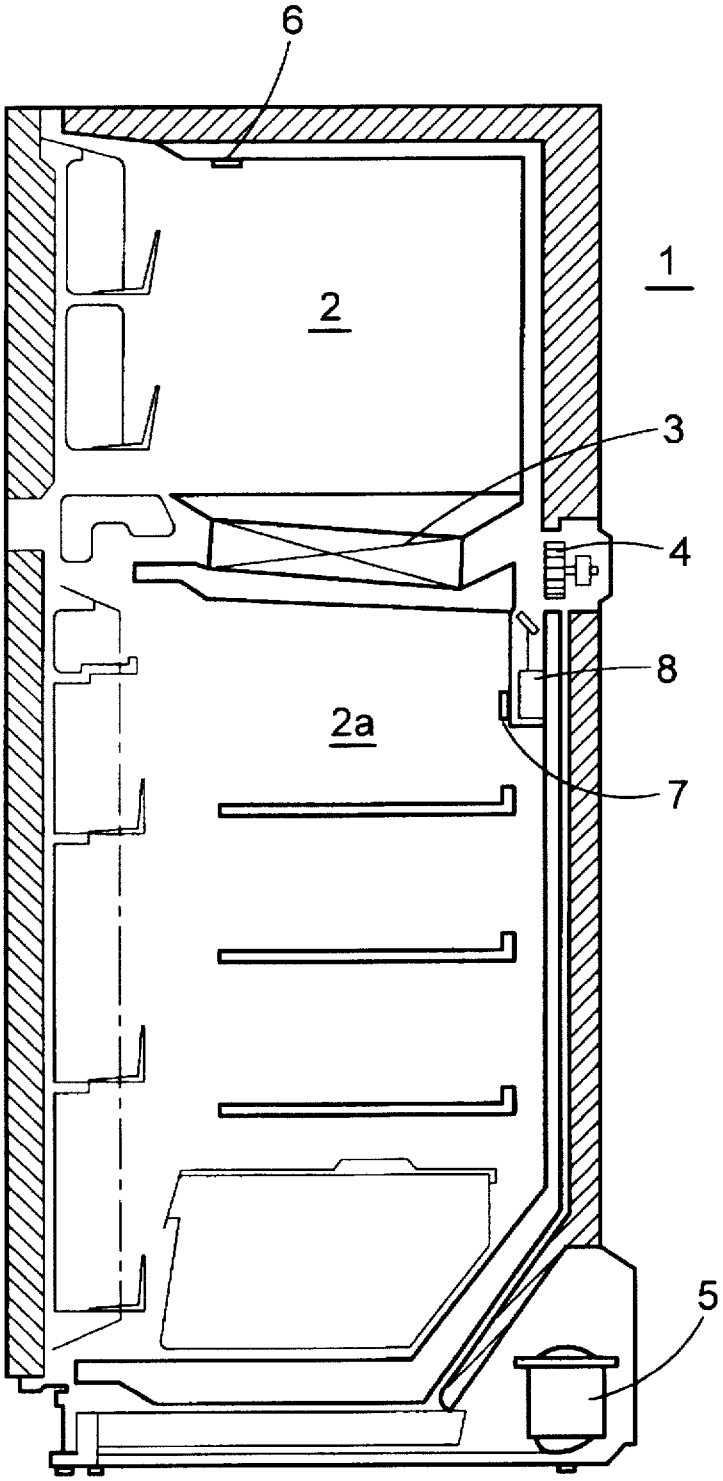
FIG. 1 (PRIOR ART)
FIG. 1 is a sectional view of the construction of a refrigerator in accordance with an embodiment of the conventional art.
Figure 2:
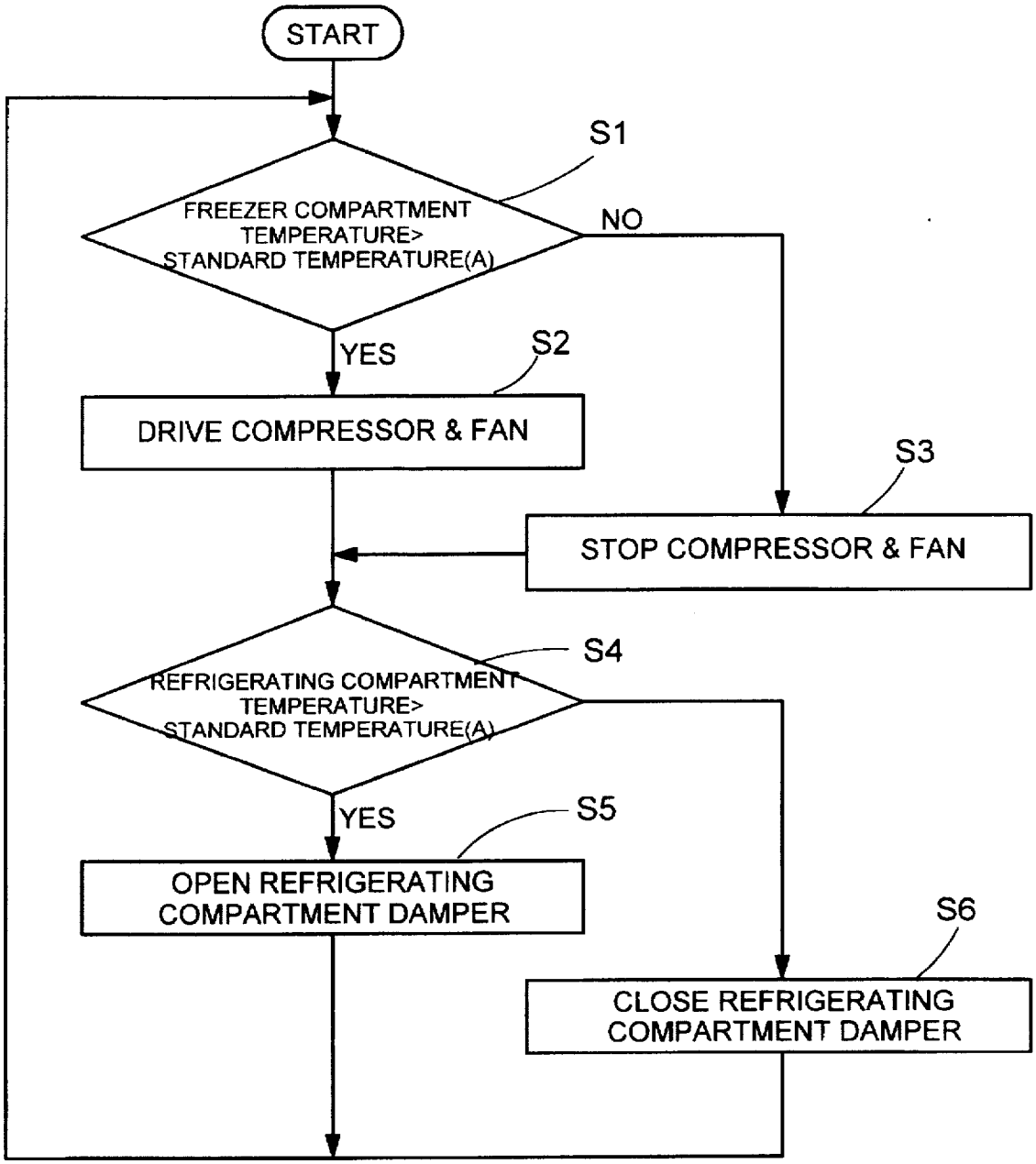
FIG. 2 (PRIOR ART)
FIG. 2 is a flow chart illustrating the control sequence for the cooling cycle of the refrigerator in accordance with the conventional art.
Figure 3:
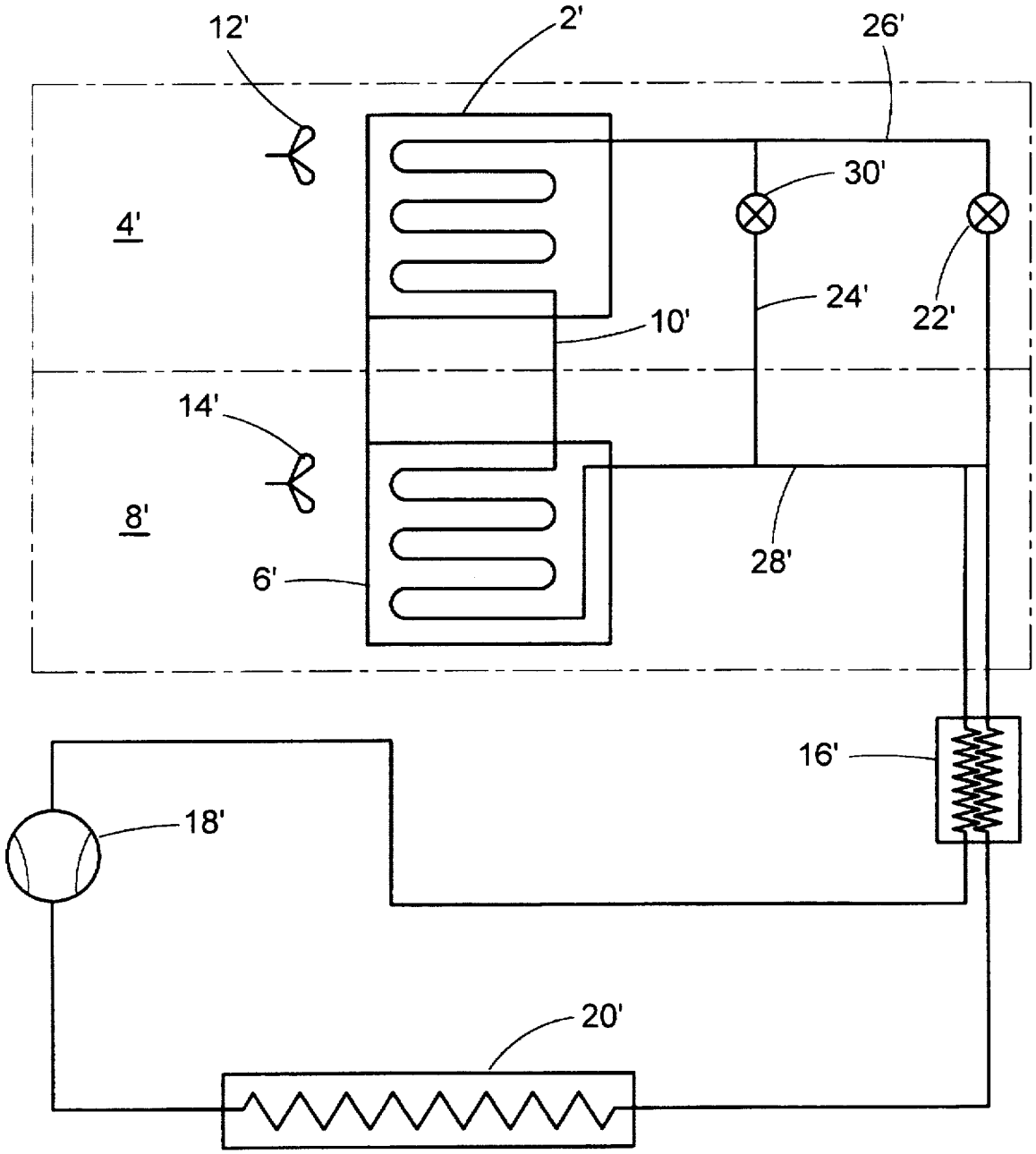
FIG. 3 (PRIOR ART)
FIG. 3 is a schematic diagram of another embodiment of the refrigeration system of the conventional art.
Figure 4:
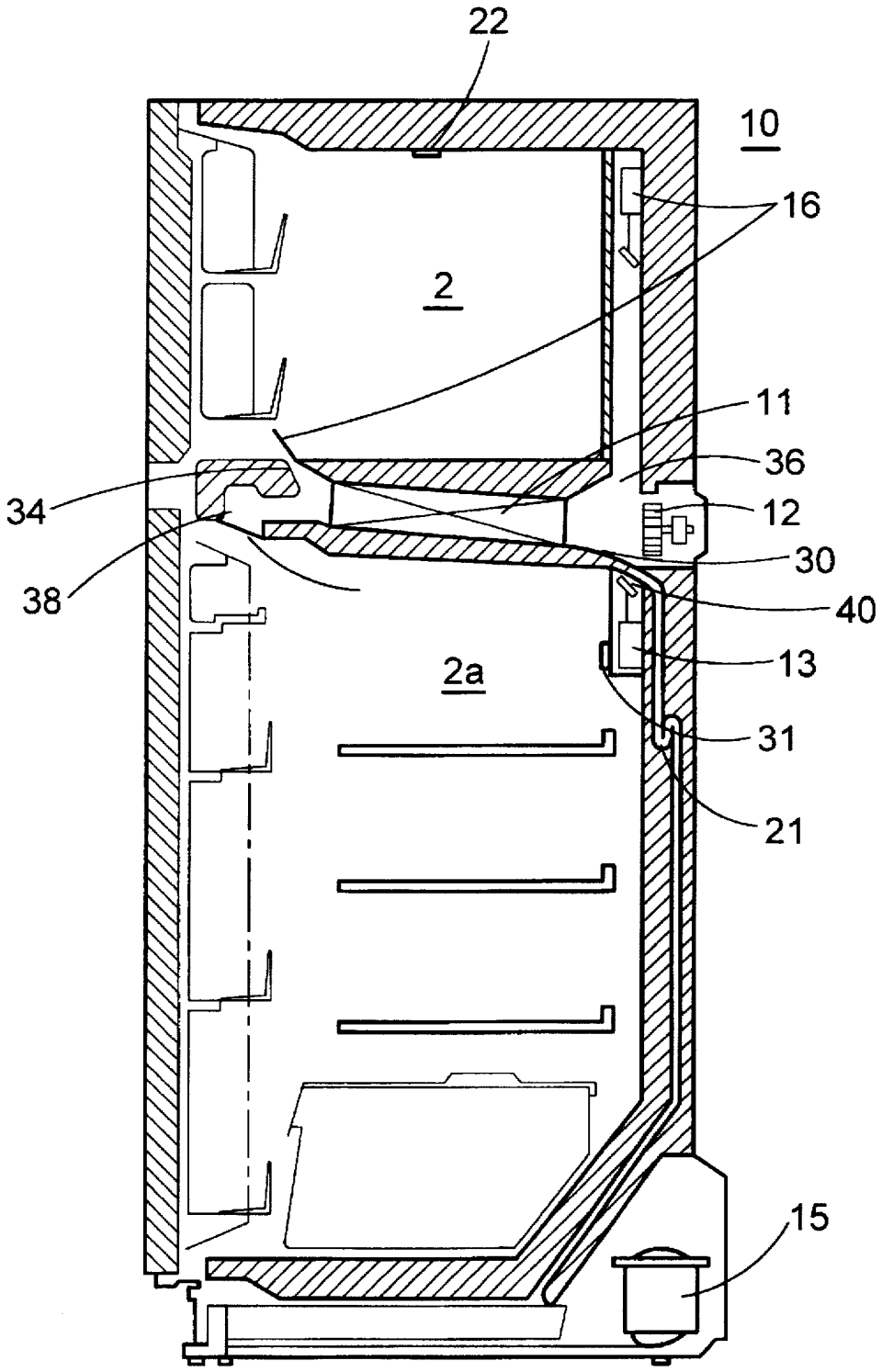
FIG. 4 (PRIOR ART)
FIG. 4 is a sectional view of the construction of a refrigerator in accordance with the present invention.
Figure 5:
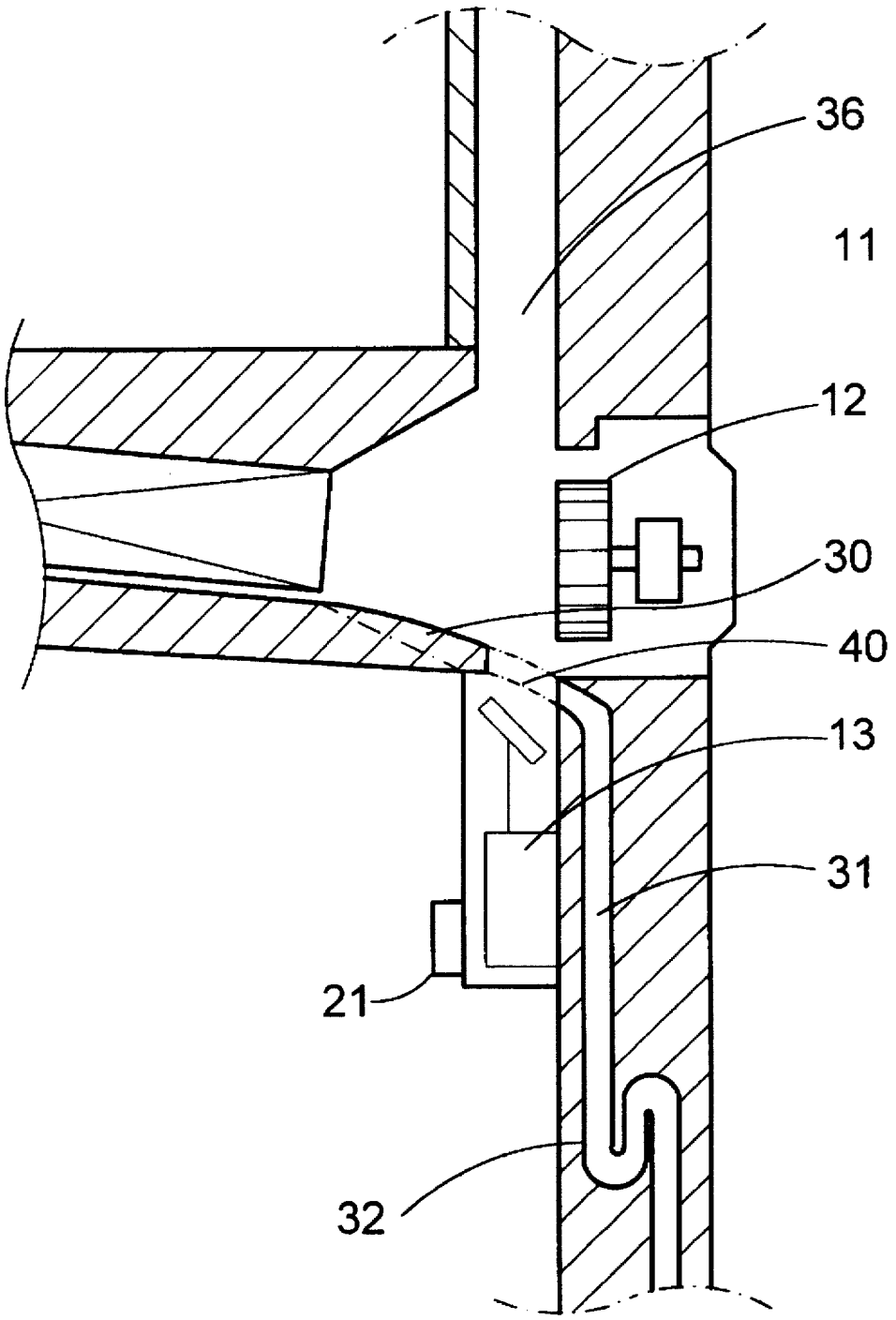
FIG. 5 depicts an internal tube used for defrost cycle of the refrigerator in accordance with the present invention.
Figure 6:
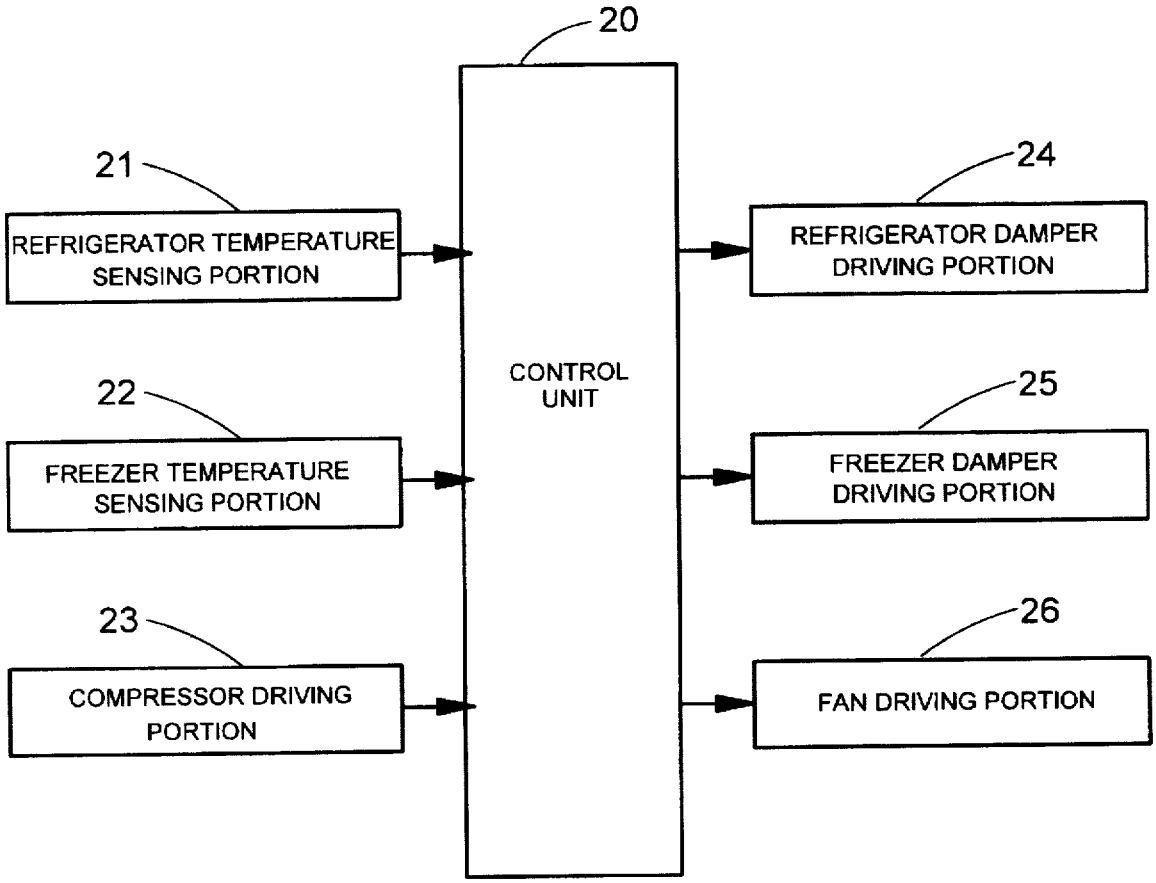
FIG. 6 is a block diagram showing the construction of the refrigerator in accordance with the present invention.

Referring to FIGS. 4 to 6, a refrigerator includes a body 10; a freezing compartment 2 and refrigerating compartment 2a which are separated by a partition; an evaporator 11 which is installed in the partition and generates cooled air; a fan 12 which is provided behind the evaporator 11 and forcedly circulates air through the freezing and refrigerating compartments 2 and 2a the air having been passed through the evaporator 11 from the freezing and refrigerating compartments 2 and 2a.

The refrigerator also includes a refrigerating compartment damper 13 that is installed within the rear wall of the refrigerating compartment 2a and controls the flow of the cool air that is forcedly circulated in the refrigerating compartment 2a by the fan 12 so that the refrigerating compartment 2a is cooled independently of the freezing compartment 2; a freezing compartment damper 16 that is installed within the rear wall of the freezing compartment 2 and controls the flow of the cool air that is forcedly circulated in the freezing compartment 2 by the fan 12 so that the freezing compartment 2 is cooled independently of the refrigerating compartments 2a; a refrigerating compartment temperature sensor 21 which detects temperatures of the refrigerating compartment 2a; a freezing compartment temperature sensor 22 which detects temperatures of the freezing compartment 2; and a compressor 15 which is installed on the lower section of the body 10 and plays an important roll in a cooling cycle together with the evaporator 11.

As shown in FIG. 5, the inventive refrigerator further includes a water collector 30 inclined downwardly toward the rear of the refrigerating compartment 2a so as to collect water created during the operation of the defrost cycle; an internal tube 31 having one end connected with the water collector 30 and the other end connected with an exterior evaporating dish. The internal tube 31 has upward- and downward-curved parts to form a vertical U-bend 32, and water created during the defrost cycle is gathered in the U-bend 32 so that outside air cannot flow through the tube 31.

The freezing compartment damper 16 opens and closes an inlet 34 formed on a front lower part of the freezing compartment 2 to admit air from the freezing compartment 2 into the partition for heat exchange, and then to an outlet 36 provided to the rear of the freezing compartment 2. The refrigerating compartment damper 13 opens and closes an inlet 38 formed on a front upper part of the refrigerating compartment 2a to enable air to flow across the evaporator 11 after exiting the refrigerating compartment 2a, and an outlet 40 through which the air of the refrigerating compartment 2a is discharged. These dampers 13 and 16 permit the freezing and refrigerating compartments to be cooled independently of each other.

The refrigerator of the present invention additionally includes a fan driving portion 26 which actuates the fan 12; a freezing compartment damper driving portion 25 which operates the freezing compartment damper 16; a refrigerating compartment damper driving portion 24 which operates the refrigerating compartment damper 13; a compressor driving portion 23 which energizes the compressor 15; and a control unit 20 that supervises the operation of the above components.

Each one of the freezing compartment temperature sensor 22 and refrigerating compartment temperature sensor 21 can comprise a thermistor. Since they have resistance values that are varied with temperatures, the resistance variation of the respective temperature sensors is provided to the control unit 20 to control the compressor 15, the fan 12, the freezing compartment damper 16, and the refrigerating compartment damper 13.

The following description relates to the control sequence for the cooling cycle of the refrigerator in accordance with the present invention.

Figure 7A:
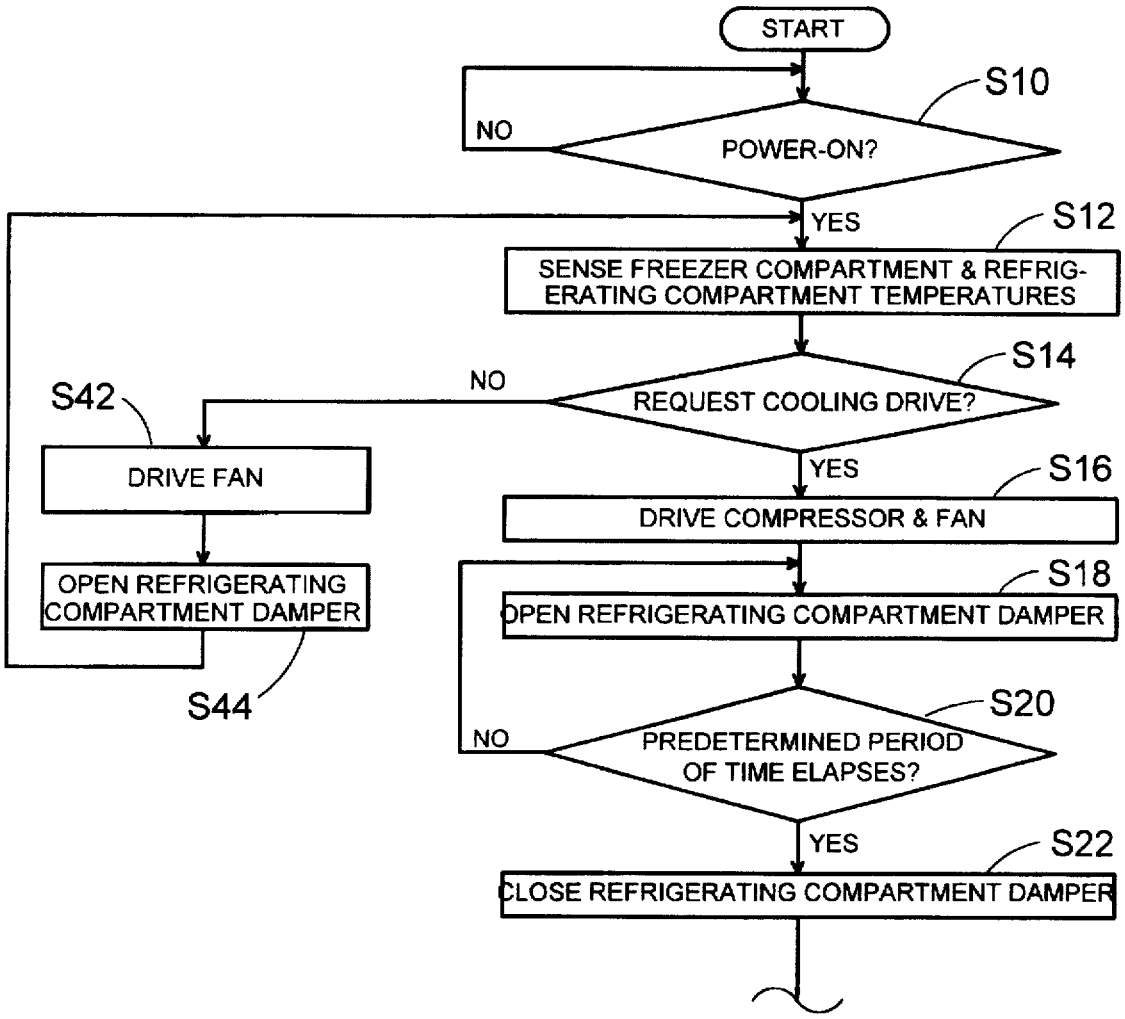
FIG. 7 is a flow chart illustrating the control sequence for the cooling cycle of the refrigerator in accordance with the present invention.
Figure 7B:
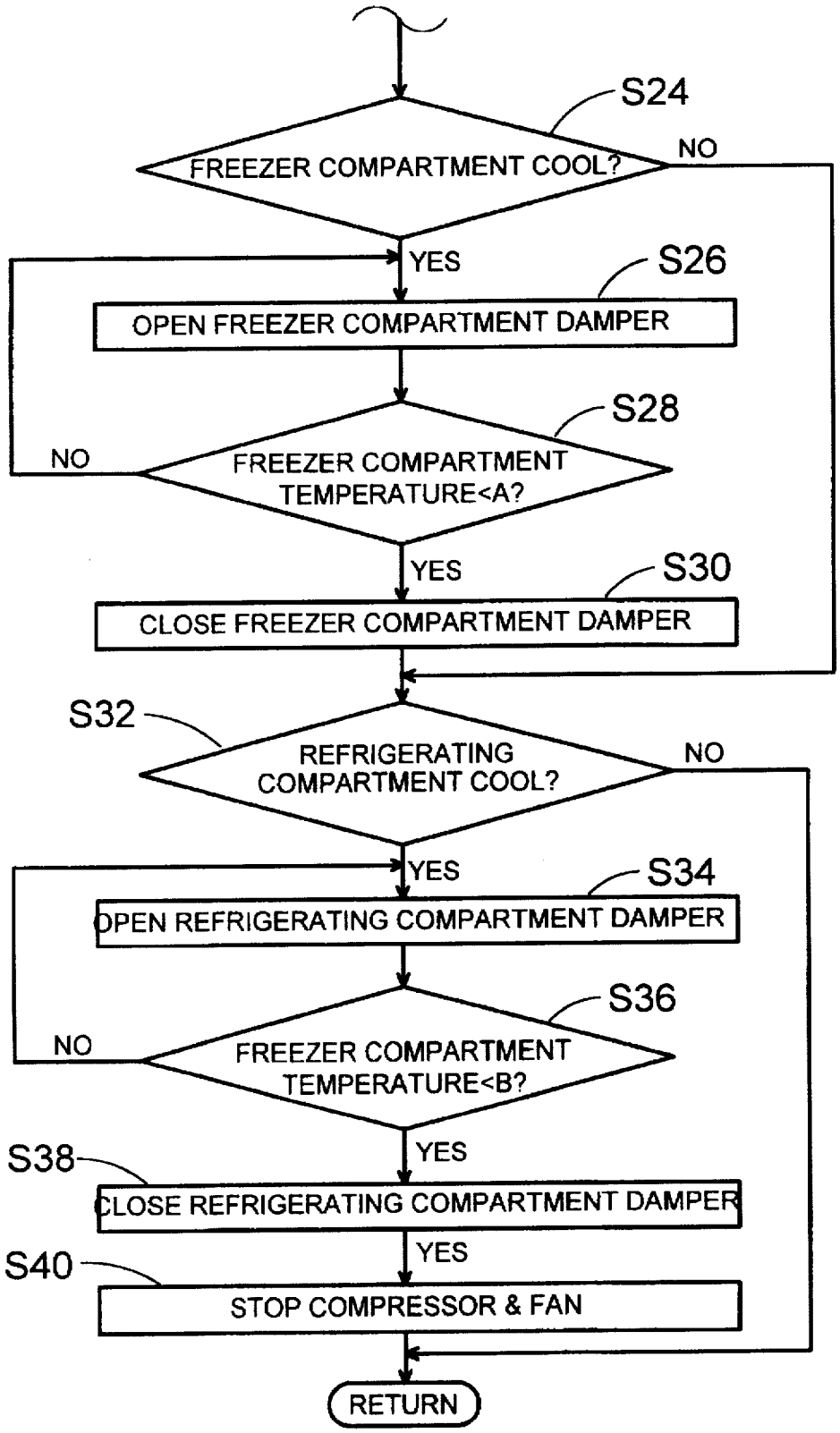

Attention is now invited to FIG. 7 which is a flowchart illustrating the control sequence for the cooling cycle of the refrigerator.

Once power is applied to the refrigerator (S10), the temperatures of the freezing and refrigerating compartments 2 and 2a are detected. The freezing compartment temperature and the refrigerating compartment temperature are compared (S14) with standard (reference) temperatures A and B preset for the respective compartments, and when the freezing compartment temperature or refrigerating compartment temperature is higher than its own standard temperature A or B, the control unit 20 interprets this as meaning that corresponding compartment requires a cooling operation.

When the control unit 20 determines that there is the demand for the cooling operation at Step 14, it allows the compressor 15 and the fan 12 to operate at Step 16. During the initial operation of the compressor 15, the evaporator 11 reaches transient pressure state, and the evaporator temperature at this stage cannot cool the freezing compartment 2. Accordingly, the refrigerating compartment damper 13 is opened at Step 18 so that the refrigerating compartment can be first cooled by the evaporator 11. In this manner, the energy established when the evaporator 11 is in the transient pressure state can be utilized in cooling to thereby provide a more efficient cooling cycle.

As the compressor 15 that began operating at Step 16 goes on working at Step 20, the evaporator 11 becomes free from the transient pressure state in a predetermined period of time so that the refrigerating compartment damper 13 is closed at Step 22. To preferentially provide cooling for one of the compartments requiring the cooling operation at Step 14, the control unit 20 detects (S24) if the temperature of the freezing compartment 2 is higher than the standard temperature A. When the control unit 20 determines that the freezing compartment temperature is higher than the standard temperature A, the freezing compartment damper 16 is opened to provide cooling therefor so as to cool the freezing compartment 2 (S26).

At Step 28 the control unit 20 compares the freezing compartment temperature with the standard temperature A preset therefor during the cooling cycle of the freezing compartment 2. If the freezing compartment temperature is higher than the standard temperature A, the procedure of Step 26 is repeatedly carried out, and if the freezing compartment temperature is lower than the standard temperature A, the freezing compartment damper 16 is closed at Step 30 to complete the cooling cycle of the freezing compartment. At Step 32 the control unit 20 compares the refrigerating compartment temperature with the standard temperature B preset therefor. If the refrigerating compartment temperature is higher than the standard temperature B, the refrigerating compartment damper 13 gets opened at Step 34 to thereby provide cooling for the refrigerating compartment **2*a***.

The refrigerating compartment temperature is compared with the standard temperature B at Step 36, and if it is lower than the standard temperature B, at Step 38 the refrigerating compartment damper 13 is closed to finish the cooling cycle, and the compressor 15 and fan 12 stop, thereby completing the cooling operation.

The control unit 20 detects (S14) if there is a demand for cooling operation to perform the initial operation of the compressor 15. When it determines that there is no compartment necessitating cooling, i.e. that the temperatures of the respective freezing compartment 2 and refrigerating compartment **2*a* are each lower than their standard temperatures A and B, it allows the fan 12 to operate at Step 42, and lets the refrigerating compartment damper 13 be opened at Step 44. Accordingly, the air of the refrigerating compartment 2*a* beyond freezing is circulated across the evaporator 11 to thereby get rid of the frost accumulating on the evaporator 11**.

As described above, according to the inventive refrigerator and cooling operation control method, each of the freezing and refrigerating compartments can be cooled at steady-state temperatures by using one evaporator. The freezing compartment damper and the refrigerating compartment damper are used to independently provide cooling for the freezing and refrigerating compartments.

In addition, when the evaporator is in the transient pressure state for a predetermined period of time during the initial stage of the compressor's operation, the refrigerating compartment is first provided with cooling by using the energy established before the evaporator reaches normal pressure state, which reduces power consumption. Since the present invention employs one evaporator and controls the flow of the cool air just by operating the cool air distribution duct and the damper, it offers a decrease in the internal capacity of the refrigerating compartment, and a refrigerant saving as well to thereby lower the overall production costs.

The present invention also provides a reliable and efficient defrosting operation by using the air of the refrigerating compartment without any auxiliary device such as a defrosting heater, a bypass line, a solenoid valve and the like.

What is claimed is:

1. A refrigerator comprising:

a refrigerating compartment;

a cooling cycle mechanism including only one evaporator for cooling both the refrigerating and freezing compartments;

means for directing cool air from the evaporator to the refrigerating compartment and not to the freezing compartment, upon a start-up of the cooling cycle mechanism, for a period enabling refrigerant pressure in the evaporator to reach a steady state condition; and means for directing cool air from the evaporator to a first of the compartments and not to a second of the compartments, following the period, and for then directing cool air from the evaporator to the second compartment and not to the first compartment.

2. A refrigerator comprising:

a refrigerating compartment;

a freezing compartment;

a partition separating the freezing compartment from the refrigerating compartment;

a cooling cycle mechanism including a compressor, and only one evaporator, the evaporation disposed in the partition;

a conduit arrangement connecting the evaporator with the refrigerating and freezing compartments;

a fan positioned for circulating air through the conduit arrangement from the refrigerating and freezing compartments across the evaporator and then back into the refrigerating and freezing compartments;

temperature sensors for sensing temperatures in the refrigerating and freezing compartments, respectively;

a damper structure disposed in the conduit arrangement for independently communicating the refrigerating and freezing compartments with the evaporator; and a controller connected to the temperature sensors, the cooling cycle mechanism, the fan and the damper structure, and being operable upon start-up of the cooling cycle mechanism to cool the refrigerating compartment and not the freezing compartment for a sufficient period to enable refrigerant pressure in the evaporator to reach a steady state condition, and for thereafter sequentially cooling the refrigerating and freezing compartments in response to the temperatures thereof being above respective reference temperatures.

3. The refrigerator according to claim 2 wherein the controller is operable to circulate air from the refrigerating compartment through the compressor without operating the cooling cycle mechanism, when neither of the compartments requires cooling.

4. The refrigerator according to claim 2 wherein the conduit arrangement comprises a conduit in the partition, a freezer air inlet communicating a first end of the conduit with one section of the freezer compartment, a freezer air outlet communicating a second end of the conduit with another section of the freezer, a refrigerating air inlet communicating the first end of the conduit with one section of the refrigerating compartment, a refrigerating air outlet communicating the second end of the conduit with another section of the refrigerating compartment; the damper structure comprising first and second freezer dampers for controlling air flow through the freezer air inlet and outlet, respectively, and third and fourth dampers for controlling air flow through the refrigerating inlet and outlet, respectively.

5. The refrigerator according to claim 2, further comprising a water collector disposed beneath the evaporator for collecting water therefrom, and a tube connected to the water collector for draining away collected water, the tube forming a vertical U-bend for preventing a leakage of air through the tube.

6. A method for operating a refrigerator which comprises a refrigerating compartment, a freezing compartment, and a cooling cycle mechanism having only one evaporator for cooling both of the refrigerating and freezing compartments, the method comprising the steps of:

A) determining whether either of the refrigerating and freezing compartments requires cooling;

B) initiating operation of the cooling cycle if either of the refrigerating and freezing compartments requires cooling in step A;

C) cooling the refrigerating compartment without cooling the freezing compartment, subsequent to step B, for a time period sufficient to ensure that refrigerant pressure in the evaporator is at a steady state condition;

D) determining whether a first of the refrigerating and freezing compartments requires cooling, subsequent to step C, and cooling the first of the compartments but not a second of the compartments, if the first compartment requires cooling; and E) determining whether the second compartment requires cooling, and then cooling the second compartment but not the first compartment subsequent to step D, if the second compartment requires cooling.

7. The method according to claim 6, wherein step C is performed for a predetermined period of time.

8. The method according to claim 6, wherein in steps D and E the first compartment is the freezing compartment, and the second compartment is the refrigerating compartment.

9. The method according to claim 6, further comprising the step of (F) conducting air from the refrigerating compartment across the evaporator without operating the cooling cycle for defrosting the evaporator, if neither of the compartments requires cooling in step A.

10. The method according to claim 9, wherein step A is repeated during step F, and wherein step F is terminated and steps B through E are performed if either of the compartments requires cooling during the repeating of step A.

11. The method according to claim 6 wherein step A comprises comparing temperatures in the refrigerating and freezing compartments with respective reference temperatures.

* * * * *